US008256861B2

(12) United States Patent
Murakami et al.

(10) Patent No.: US 8,256,861 B2
(45) Date of Patent: Sep. 4, 2012

(54) DROPLET EJECTION APPARATUS

(75) Inventors: Atsushi Murakami, Kanagawa (JP); Masaki Kataoka, Kanagawa (JP); Masahito Katada, Kanagawa (JP); Yuko Katada, legal representative, Kanagawa (JP); Natsuki Katada, legal representative, Kanagawa (JP); Daichi Katada, legal representative, Kanagawa (JP); Tetsuzo Kadomatsu, Kanagawa (JP)

(73) Assignees: Fuji Xerox Co., Ltd., Tokyo (JP); Fujifilm Corporation, Tokyo (JP)

( * ) Notice: Subject to any disclaimer, the term of this patent is extended or adjusted under 35 U.S.C. 154(b) by 343 days.

(21) Appl. No.: 12/643,013

(22) Filed: Dec. 21, 2009

(65) Prior Publication Data

US 2010/0188454 A1 Jul. 29, 2010

(30) Foreign Application Priority Data

Jan. 26, 2009 (JP) ..... 2009-013901

(51) Int. Cl.
*B41J 29/38* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS

| | | | | |
|---|---|---|---|---|
| 2005/0078144 | A1* | 4/2005 | Yamada et al. | 347/30 |
| 2007/0115317 | A1* | 5/2007 | Nishida | 347/25 |
| 2008/0174631 | A1* | 7/2008 | Habashi | 347/30 |

FOREIGN PATENT DOCUMENTS

| | | |
|---|---|---|
| JP | 11-91137 | 4/1999 |
| JP | 2005-349843 | 12/2005 |

* cited by examiner

*Primary Examiner* — Laura Martin
(74) *Attorney, Agent, or Firm* — Fildes & Outland, P.C.

(57) ABSTRACT

A droplet ejection apparatus includes a common flow path; droplet ejection units each respectively including a first distribution port; first flow paths that respectively connect each first distribution port to the common flow path; first open/close mechanisms provided respectively at the first flow paths; a first pressurizing unit that applies a positive pressure to the common flow path; a second open/close mechanisms provided at the common flow path at the first pressurizing unit side of connection portions that connect the common flow path and the respective first flow paths; and a controller. When the second open/close mechanism is closed, the controller opens only one or more first open/close mechanisms corresponding to one or more target droplet ejection units, applies positive pressure to a section of the common flow path at the first pressurizing unit side of the second open/close mechanism, and then opens the second open/close mechanism.

9 Claims, 13 Drawing Sheets

TRANSITION OF PRESSURE INSIDE COMMON FLOW PATH IN EXEMPLARY EMBODIMENT

TRANSITION OF PRESSURE INSIDE COMMON FLOW WHEN INK SUPPLY IS STARTED BY OPENING SUPPLY VALVES (CONVENTIONAL TECHNIQUE)

WHEN RECOVERY COMMON FLOW PATH IS PRESSURIZED

WHEN THERE IS FLOW FROM MODULE TO RECOVERY COMMON FLOW

WHEN THERE IS NEITHER FLOW NOR PRESSURE DIFFERENCE

WHEN THERE IS FLOW FROM MODULE TO RECOVERY COMMON FLOW PATH

WHEN THERE IS NEITHER FLOW NOR PRESSURE DIFFERENCE, OR WHEN RECOVERY COMMON FLOW PATH IS PRESSURIZED

WHEN THERE IS FLOW FROM MODULE TO RECOVERY COMMON FLOW PATH

WHEN THERE IS NEITHER FLOW NOR PRESSURE DIFFERENCE, OR WHEN RECOVERY COMMON FLOW PATH IS PRESSURIZED

CONFIGURATION OF SUB-TANK

WHEN PRESSURE IS HIGH

WHEN PRESSURE IS LOW

DROPLET EJECTION APPARATUS

CROSS-REFERENCE TO RELATED APPLICATION

This application is based on and claims priority under 35 USC 119 from Japanese Patent Application No. 2009-013901 filed on Jan. 26, 2009.

BACKGROUND

1. Technical Field

The present invention relates to a droplet ejection apparatus.

2. Related Art

In an inkjet recording apparatus, ink retained inside nozzles that eject ink droplets will be deteriorated as a result of contacting with air. Therefore, a maintenance operation is needed to be performed regularly, in which the ink retained inside the nozzles and ink retained inside a recording head in which the nozzles are formed are replaced by ejecting (discharging) the ink droplets from the nozzles.

SUMMARY

An aspect of the present invention is a droplet discharge apparatus including: a common flow path that distributes a liquid; plural droplet ejection units each respectively including at least a first distribution port that supplies the liquid and an ejection mechanism that ejects the supplied liquid as droplets; plural first flow paths that respectively connect each first distribution port to the common flow path; plural first opening and closing mechanisms provided respectively at the plurality of first flow paths; a first pressurizing unit that applies a positive pressure at least to the common flow path; a second opening and closing mechanism provided at the common flow path at the first pressurizing unit side of connection portions that connect the common flow path and the respective first flow paths; and a controller that, when the second opening and closing mechanism is closed, opens only one or more first opening and closing mechanisms corresponding to one or more target droplet ejection units which are maintenance targets, applies positive pressure by the first pressurizing unit to a section of the common flow path at the first pressurizing unit side of the second opening and closing mechanism, and then opens the second opening and closing mechanism.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
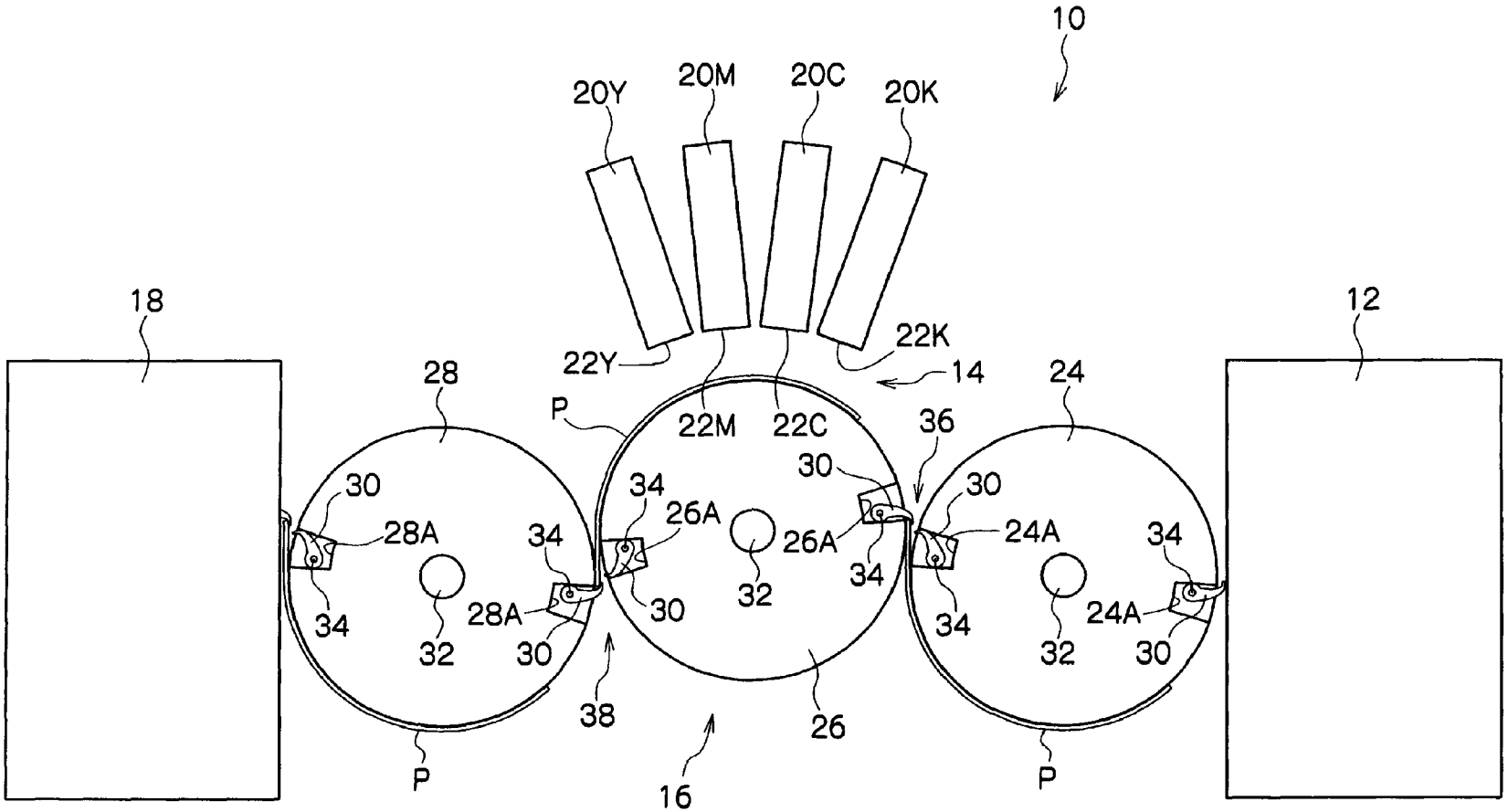
FIG. 1 is a schematic configuration diagram of an ink jet recording apparatus according to the exemplary embodiments.

FIG. 1 shows an ink jet recording apparatus 10 according to the exemplary embodiments. The ink-jet recording apparatus 10 ejects ink droplets to record an image on a recording medium, and corresponds to an ink jet recording apparatus of the present invention. As shown in FIG. 1, the ink jet recording apparatus 10 has a recording medium storage 12 in which a recording medium P such as paper is stored, an image recording unit 14 that records an image on the recording medium P, a conveyance unit 16 that conveys the recording medium P from the recording medium storage 12 to the image recording unit 14, and a recording-medium discharge unit 18 that ejects the recording medium P on which an image is recorded by the image recording unit 14.

The image recording unit 14 has ink-jet recording heads 20Y, 20M, 20C, and 20K. The ink jet recording heads 20Y to 20K are disposed along a conveyance direction of the recording medium P in this order, and respectively eject inks of colors (Y (yellow), M (magenta), C (cyan), and K (black)) different from one another through plural nozzles as droplets (ink droplets), using ejection mechanisms incorporated in the ink jet recording heads 20Y to 20K in piezoelectric method. In this way, a color image is recorded on the recording medium P. The ejection mechanisms of the ink-jet recording heads 20Y to 20K may be configured to eject the ink droplets by a method other than the piezoelectric method (e.g., by a thermal method or the like).

The nozzles (not illustrated) of the ink-jet recording heads 20Y to 20K are formed in surfaces (nozzle surfaces 22Y to 22K) opposing to the recording medium P of the ink jet recording heads 20Y to 20K. Each of the nozzle surfaces 22Y to 22K of the ink-jet recording heads 20Y to 20K is formed so that the length of a recordable area of each of the ink-jet recording heads 20Y to 20K along a width direction of the recording medium P is substantially equal to or greater than a maximum width of the recording medium P to which image recording is expected to be performed by the ink-jet recording apparatus 10.

The conveyance unit 16 has a taking-out drum 24 that takes out the recording medium P stored in the recording medium storage 12 one by one, a conveyance drum 26 that conveys the recording medium P to a position opposing to the nozzle surfaces 22Y to 22K of the ink jet recording heads 20Y to 20K of the image recording unit 14, and a sending-out drum 28 that sends out the recording medium P on which an image is recorded by the image recording unit 14 to the recording-medium discharge unit 18. Each of the taking-out drum 24, the conveyance drum 26, and the sending-out drum 28 hold the recording medium P on the circumferential surface thereof by an electrostatic adsorption or a non-electrostatic adsorption such as suction, adhesion or the like.

Further, the taking-out drum 24, the conveyance drum 26 and the sending-out drum 28 respectively have pairs of concavities 24A, 26A, 28A in the circumferential surface thereof. Inside the concavities 24A, 26A, 28A of the drums 24, 26, 28, rotating shafts 34 are supported at respective predetermined positions and in parallel to rotating shafts 32 of the drums 24, 26, 28. Plural grippers 30 are fixed to the respective rotating shafts 34 with intervals (e.g., with even intervals) in an axial direction thereof. Each of the rotating shafts 34 rotates in both forward and backward directions by an actuator which is not shown. Due to this rotation, the gripper 30 fixed to the each of the rotating shafts 34 is rotated between a first position at which a tip portion projects out from the circumferential surface of the drum and come into contact with the circumferential surface of the drum, and a second position at which the whole gripper 30 is substantially accommodated in the concavity. The grippers 30 thus can nip and hold an end portion of the recording medium P which is downstream in the conveyance direction, or release the same. Each of the drums 24, 26, 28 can hold up to two recording mediums P on the circumferential surface thereof by the grippers 30, and can further pass the recording medium P between the respective drums 24, 26, 28.

Here passing of the recording medium P from the taking-out drum 24 to the conveyance drum 26 is described for instance. In a state in which the grippers 30 of the conveyance drum 26 side are at positions where they slightly rotate from the first position toward the second position (i.e., position where a gap is formed between the tip portion of each of the grippers 30 and the circumferential surface of the conveyance drum 26), a leading end of the recording medium P conveyed by the taking-out drum 24 reaches a pass position 36 at which the circumferential surface of the taking-out drum 24 opposes the circumferential surface of the conveyance drum 26. Then, the grippers 30 of the taking-out drum 24, which have held the leading end of the recording medium P, rotate to the second position, and the leading end of the recording medium P enters into the gaps between the tip portions of the grippers 30 of the conveyance drum 26 and the circumferential surface of the conveyance drum 26. In this state, the grippers 30 of the conveyance drum 26 are rotated to the first position, and the leading end of the recording medium P is nipped and held between the tip portions of the grippers 30 and the circumferential surface of the conveyance drum 26. In this way, the passing of the recording medium P from the taking-out drum 24 to the conveyance drum 26 is completed.

In image recording on the recording medium P, the recording medium P stored in the recording medium storage 12 is taken out one by one from the recording medium storage 12 by the grippers 30 of the taking-out drum 24 and held, conveyed while being held on the circumferential surface of the taking-out drum 24, and passed from the grippers 30 of the taking-out drum 24 to the grippers 30 of the conveyance drum 26 at the pass position 36. The recording medium P held by the grippers 30 of the conveyance drum 26 is conveyed to an image recording position by the ink jet recording heads 20Y to 20K while being held on the circumferential surface of the conveyance drum 26, and an image is recorded on a recording surface of the recording medium P using the ink droplets ejected from the inkjet recording heads 20Y to 20K. The recording medium P having the image recorded on the recording surface is passed from the grippers 30 of the conveyance drum 26 to the grippers 30 of the sending-out drum 28 at a pass position 38. The recording medium P held by the grippers 30 of the sending-out drum 28 is conveyed while being held on the circumferential surface of the sending-out drum 28 and ejected to the recording-medium discharge unit 18.

Next, the configuration of an ink supply system that supplies the inks to the ink jet recording heads 20Y to 20K of the image recording unit 14 is described. Since the ink supply systems corresponding to the respective ink-jet recording heads 20Y to 20K have the same configuration, the configuration of the ink supply system of the ink-jet recording head 20Y is described as an example.

Figure 2:
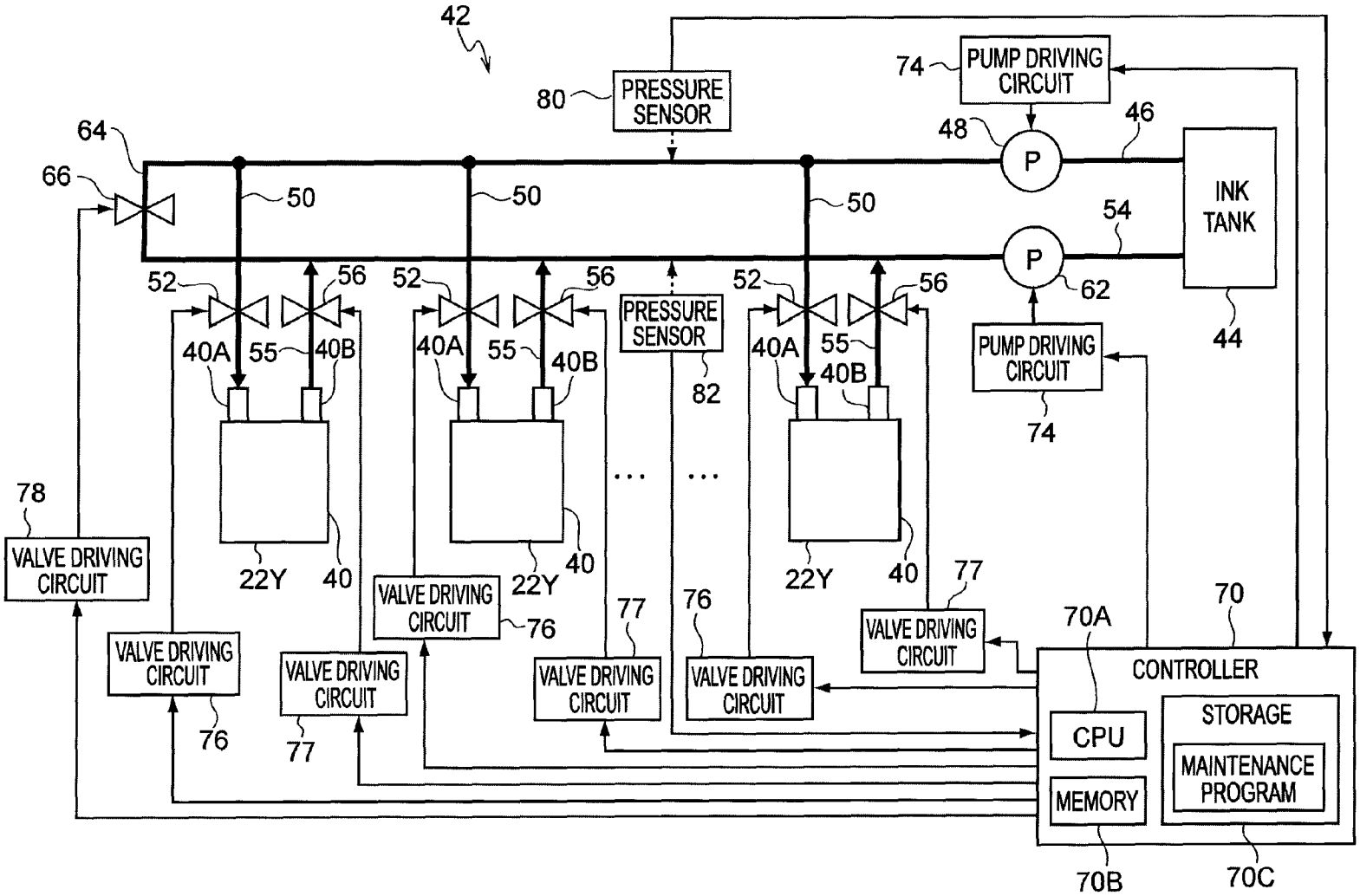
FIG. 2 is a schematic configuration diagram of an ink supply system according to a first exemplary embodiment.

FIG. 2 shows an ink-supply system 42 of the ink-jet recording head 20Y. The ink-jet recording head 20Y has plural ink-droplet ejection modules 40 (similarly in the ink-jet recording heads 20M to 20K). Each of the ink-droplet ejection modules 40 is provided with a supply port 40A for supplying the ink (as one example of a liquid) to the ink-droplet ejection module 40, and a discharging port 40B for discharging the ink from the ink-droplet ejection module 40. The ink-droplet ejection module 40 corresponds to a droplet ejection unit.

The ink supply system 42 includes an ink tank 44 that stores the ink (more particularly, ink in Y color because the ink supply system 42 shown in FIG. 2 is for the ink jet recording head 20Y). The ink stored in the ink tank 44 includes various inks such as a water-based ink, an oil-based ink, a solvent ink and the like. One end of a supply common tube 46 is connected to the ink tank 44. The supply common tube 46 is made in, for example, tubular form, and the ink can be distributed therethrough.

A supply pump 48 is disposed at the supply common tube 46. The supply pump 48 can be rotated normally and reversely. When the supply pump 48 is normally rotated, pressure (positive pressure) is applied inside the supply common tube 46 and the ink stored in the ink tank 44 is fed in the supply common tube 46 toward the ink-droplet ejection module 40. The supply pump 48 may be rotated reversely only for a short time in a state in which the pressure is applied inside the supply common tube 46, and in this case, the pressure applied to the supply common tube 46 is released and the feeding of the ink is stopped.

At plural different positions of the supply common tube 46, one ends of plural supply tubes 50 are respectively connected, and the other ends of the plural supply tubes 50 are respectively connected to the supply port 40A of the plural ink-droplet ejection modules 40. Each of the supply tubes 50 is also made in tubular form as well as the supply common tube 46, and the ink can be distributed through the tube. Thus, due to the normal rotation of the supply pump 48, the ink fed toward the ink-droplet ejection module 40 through the supply common tube 46 is distributed to each of the supply tubes 50 and is supplied to each of the ink-droplet ejection modules 40 through the supply port 40A thereof.

At the supply tubes 50, supply valves 52 which are an openable valves, are respectively disposed. When the supply valve 52 is in an opened state, the ink can be flow through the supply tube 50. When the supply valve 52 is switched to a closed state, the ink flow inside the supply tube 50 is blocked, and the supply of the ink to the corresponding ink-droplet ejection module 40 is also stopped. As the supply valve 52, for example, a solenoid valve, which is opened and closed by a force generated by a solenoid, can be used. However, any other configuration, such as a valve opened or closed by a driving force of a motor, or the like may be employed. The position of the supply valve 52 is not limited to on the supply tube 50. The supply valve 52 may be provided at the supply port 40A of the ink-droplet ejection module 40 to open and close the supply port 40A.

One end of a recovery common tube 54 is also connected to the ink tank 44. The recovery common tube 54 is also made in tubular form, and the ink can flow through the tube. At plural different positions of the recovery common tube 54, one ends of plural recovery tubes 55 are respectively connected, and the other ends of the plural recovery tubes 55 are respectively connected to the discharging ports 40B of the plural ink-droplet ejection modules 40. Each of the recovery tubes 55 is also made in tubular form, and the ink can be flow though the tube. The above-described recovery tubes 55 and the recovery common tube 54 form a discharging flow path for guiding the ink discharged from the discharging ports 40B of the plural ink-droplet ejection modules 40 to the ink tank 44.

Moreover, on each of the recovery tubes 55, a recovery valve 56 made of an openable valve is disposed, respectively. When the recovery valve 56 is in an opened state, the ink can flow inside the recovery tube 55, and when the recovery valve 56 is switched into a closed state, the flown of the ink inside the recovery discrete tube 55 is blocked, and discharge of the ink from the corresponding ink-droplet ejection module 40 is also stopped. Similarly to the supply valve 52, a solenoid valve, the recovery valve 56 may be, for example, a solenoid valve, which is opened and closed by a force generated by a solenoid. Alternately, any other configuration, in which the valve is opened or closed by a driving force of a motor, or the like, may be employed. A position of the recovery valve 56 is not limited to on the recovery tube 55. The recovery valve 56 may be provided at the discharging port 40B of the ink-droplet ejection module 40 to open and close the discharging port 40B.

A recovery pump 62 is disposed on the recovery common tube 54. The recovery pump 62 is also enabled to normally and reversely rotate. When the recovery pump 62 is normally rotated, pressure (positive pressure) is applied to the supply common tube 46 and the recovery tubes 55. When the recovery pump 62 is reversely rotated, pressure (negative pressure) is applied to the recovery common tube 54 and the respective recovery tubes 55. At this time, if the respective recovery valves 56 corresponding to the respective ink-droplet ejection modules 40 are in an opened state, the discharge of the ink from the respective ink-droplet ejection modules 40 are promoted.

As described above, in the ink supply system 42 according to the exemplary embodiment, a circulation pathway for circulating the ink is formed by the ink tank 44, the supply common tube 46, the respective supply tubes 50, the respective ink-droplet ejection modules 40 of the ink jet recording head 20Y, the respective recovery tubes 55, and the recovery common tube 54. A controller 70, which is described later, actuates the supply pump 48 and the recovery pump 62 during a period when a maintenance operation, which is described later, is not performed (e.g., an image recording period when an image recording on the recording medium P is performed, or a stand-by period when an image recording is not performed) and generate pressure to circulates the ink through the circulation pathway. Thus the ink is circulated through the circulation pathway, and the ink remaining inside the circulation pathway is maintained to be clean.

Further, an end portion of the supply common tube 46 opposite to the end portion connected to the ink tank 44 and an end portion of the recovery common tube 54 opposite to the end portion connected to the ink tank 44 are connected with a communication tube 64. The communication tube 64 is also made in tubular form, and the ink can flow through the tube. A communication valve 66 formed by an openable valve is disposed at the communication tube 64. When the communication valve 66 is in an opened state, the ink can flow through the communication tube 64, and when the communication valve 66 is switched to a closed state, the flow of the ink inside the communication tube 64 (i.e., between the supply common tube 46 and the recovery common tube 54) is blocked. The communication valve 66 may be a solenoid valve or any other configuration.

The ink supply system 42 includes the controller 70. The controller 70 includes a CPU 70A, a memory 70B, and a nonvolatile storage 70C formed of a Hard Disk Drive (HDD), a flash memory or the like. The storage 70C stores a maintenance program for performing the maintenance processing described later by the CPU 70A. The supply pump 48 is connected with the controller 70 through a pump driving circuit 72, and the recover pump 62 is connected with the controller 70 through a pump driving circuit 74, respectively, so that the operations of the supply pump 48 and the recovery pump 62 are controlled by the controller 70. The respective supply valves 52 are connected to the controller 70 through valve driving circuits 76 and the communication valve 66 is connected to the controller 70 through a valve driving circuit 78, so that the opening and closing of the respective supply valves 52 and the communication valve 66 are also controlled by the controller 70.

In the supply common tube 46, a pressure sensor 80 is provided that detects pressure in a section of the supply common tube 46 at the ink-droplet ejection module 40 side from the supply pump 48. In the recovery common tube 54, a pressure sensor 82 is provided that detects a pressure in a section of the recovery common tube 54 at the ink-droplet ejection module 40 side from the recovery pump 62. The pressure sensors 80, 82 are connected to the controller 70, and detection results of the pressure by the pressure sensors 80, 82 are outputted to the controller 70.

The ink supply system 42 includes maintenance units (not shown) used when performing the maintenance operations for the respective ink-droplet ejection modules 40. The maintenance unit has caps that cover nozzle surfaces of the ink-droplet ejection modules 40 of the ink-jet recording heads 20Y to 20K, a receiving member that receives the ink droplets ejected in a preliminary ejection (idle ejection), a cleaning member that cleans the nozzle surfaces, and a suction device for suctioning the ink inside the nozzles. The maintenance unit can move to opposite positions where are opposing to the corresponding ink-droplet ejection module 40. The maintenance units are also connected to the controller 70 (not illustrated), are moved to the opposite positions in accordance with instructions from the controller 70, and perform various maintenance operations.

Although the illustration is omitted, the controller 70 is also connected to ejection mechanisms incorporated in the ink jet recording heads 20Y to 20K (in the respective ink-droplet ejection modules 40 thereof), and performs ink-droplet ejection control processing, in which the nozzle to eject the ink droplet, and an eject time of the ink droplet from the nozzle are determined in accordance with an image signal, and a drive signal is supplied to the corresponding ejection mechanism at a time in accordance with the determined ejection time. Further, processing for controlling the operation of the overall ink jet recording apparatus 10 may be also performed in the controller 70.

In the exemplary embodiment, the supply common tube 46, the recovery common tube 54 and the communication tube 64 correspond to a common flow path. More particularly, the supply common tube 46 corresponds to a second common flow path, the recovery common tube 54 corresponds to a first common flow path, and the communication tube 64 corresponds to a communication flow path, respectively. Moreover, in the exemplary embodiment, the supply port 40A corresponds to a first distribution port, the discharging port 40B corresponds to a second distribution port, the supply tube 50 corresponds to a first flow path, the recovery tube 55 corresponds to a second flow path, the supply valve 52 corresponds to a first opening and closing mechanism, the recovery valve 56 corresponds to a third opening and closing mechanism, the communication valve 66 corresponds to a second opening and closing mechanism, the supply pump 48 corresponds to a second pressurizing unit, the recovery pump 62 corresponds to a first pressurizing unit, the pressure sensor 82 corresponds to a pressure detector, and the controller 70 corresponds to a controller, respectively.

Figure 3:
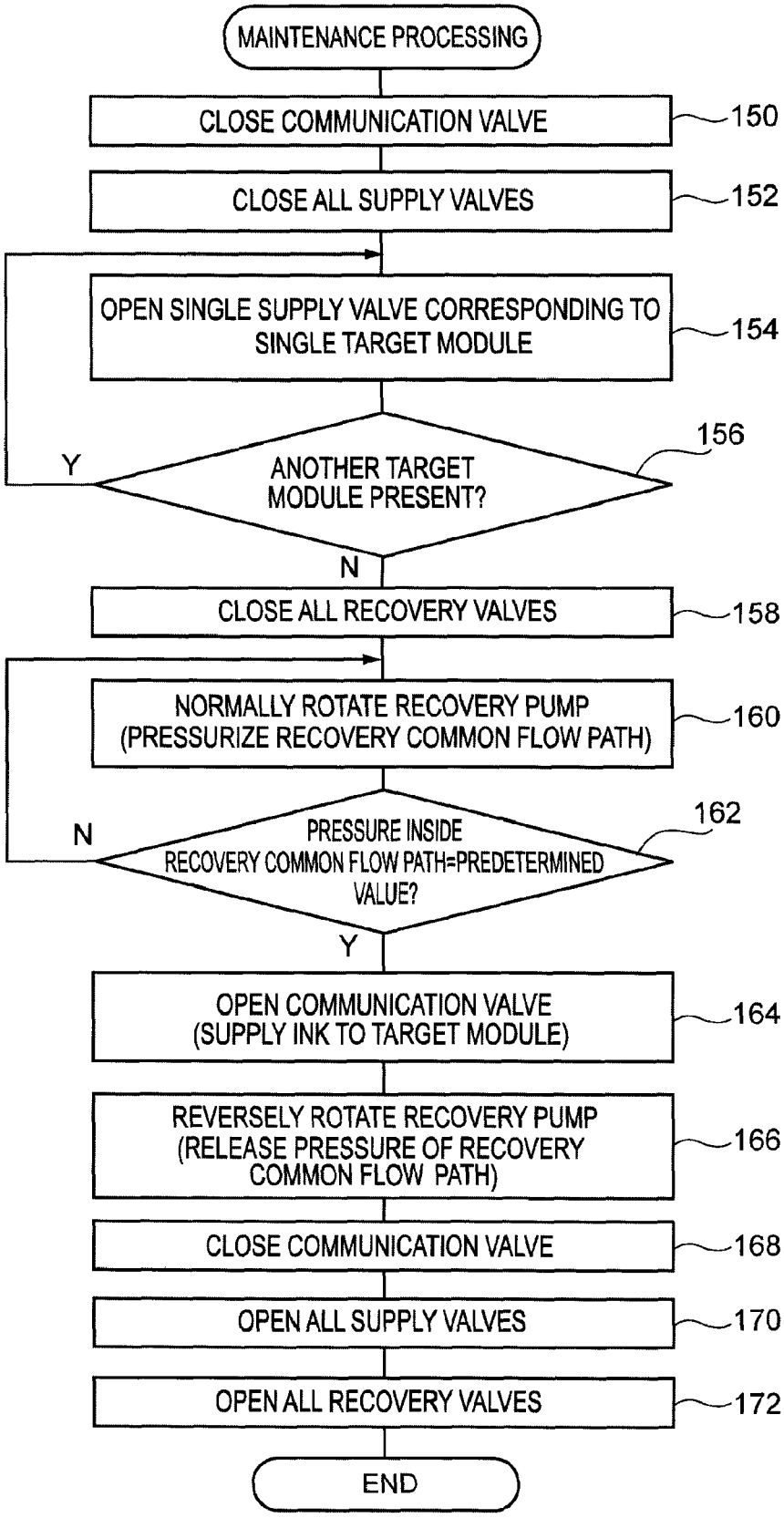
FIG. 3 is a flowchart showing contents of maintenance processing according to the first exemplary embodiment.

Next, in a case in which the maintenance operation is performed for any one of the ink-droplet ejection modules 40 of any recording head 20 of the ink-jet recording heads 20Y to 20K, the maintenance processing performed by the controller 70 as a result of the CPU 70A executing the maintenance program is described as an operation of the first exemplary embodiment with reference to FIG. 3.

In step 150 of the maintenance processing, a communication valve 66 is closed by the valve driving circuit 78. Thereby the flow of the ink between the supply common tube 46 and the recovery common tube 54 is blocked. In next step 152, all of the supply valves 52 provided at the respective supply tubes 50 are closed by the valve driving circuits 76. The procedure of this closing of the supply valves 52 may be performed in several times as in steps 154 and 156, which are described later. In next step 154, a single supply valve 52 corresponding to a single ink-droplet ejection module 40 which is a maintenance target (i.e., target ink-droplet ejection module 40) is opened by the valve driving circuit 76. In step 156, it is determined that whether or not another target ink-droplet ejection module 40 is still present. When the number of the target ink-droplet ejection modules 40 is one, the above-described determination is negative. When the maintenance operations are performed to plural ink-droplet ejection modules 40, the determination in step 156 is affirmative, the processing returns to step 154, and steps 154, 156 are repeated until the determination in step 156 is negative.

In the exemplary embodiment, it is configures that, when the supply valve 52 is opened in step 154, the ink is not supplied to the corresponding ink-droplet ejection module 40, and that once the communication valve 66 is opened, as will be described later, the ink is supplied to the ink-droplet ejection module 40 corresponding to the supply valve 52 that is in the opened state at that time. Thus, in the above-described steps 154 and 156, the supply valves 52 corresponding to the target ink-droplet ejection modules 40s are opened one by one. Although a current of several hundreds mA flows when one solenoid valve is driven to be opened or closed, by opening the supply valves 52 one by one as described above, a maximum value of the current flowing due to the opening of the supply valves 52 will also be only several hundreds mA. That is, when performing the maintenance operation for the N ($N \geqq 2$) ink-droplet ejection modules 40, the maximum value of the current flows is reduced to 1/N as compared with a case in which the corresponding N supply valves 52 are simultaneously opened.

The embodiments are not limited to the opening of the supply valves 52 one by one, and in opening the N ($N \geqq 2$) supply valves 52, the N supply valves 52 may be opened in several times, and the number of the opened supply valves 52 may not necessarily be fixed.

When the supply valves 52 corresponding to all of the target ink-droplet ejection modules 40 are opened, and thereby resulting in a state where the ink can be supplied only to the target ink-droplet ejection modules 40 among the plural ink-droplet ejection modules 40, the determination in step 156 is negative, and the processing moves to step 158. In step 158, all of the recovery valves 56 provided in the respective recovery tubes 55 are closed by the valve driving circuits 77. The procedure of this closing of the recovery valves 56 may also be performed in several times as in steps 154 and 156.

In step 160, the recovery pump 62 is normally rotated by the pump driving circuit 74. Due to the normal rotation of the recovery pump 62, pressure (positive pressure) is applied to a section between the communication valve 66 and the recovery pump 62 in the common flow path formed of the supply common tube 46, the recovery common tube 54 and the communication tube 64, and the pressure inside the section of the common flow path is gradually increased due to the continuation of the normal rotation of the recovery pump 62. In step 162, a detection result of the pressure inside the section of the common flow path is obtained from the pressure sensor 82. It is determined whether or not the pressure of the section indicated by the obtained detection result has reached a predetermined value, which is set in advance as a pressure at the time of maintenance operation (refer to "setting pressure at the time of maintenance" shown in FIG. 4). When the determination is negative, the processing returns to step 160, and steps 160 and 162 are repeated until the determination in step 162 becomes affirmative.

When the pressure of the section between the communication valve 66 and the recovery pump 62 of the common flow path has reached the predetermined value, the determination in step 162 becomes affirmative, and the processing moves to step 164, in which the communication valve 66 is opened by the valve driving circuit 78. Thereby, the pressure (positive pressure) accumulated in the section between the communication valve 66 and the recovery pump 62 of the common flow path is transmitted to the supply common tube 46 through the communication tube 64 and the communication valve 66, and pressure (positive pressure) is applied to the supply common tube 46. At this time, since the supply valve 52 corresponding to the target ink-droplet ejection module 40 is in the opened state, the ink is supplied to the target ink-droplet ejection module 40 due to the pressure (positive pressure) applied to the supply common tube 46. When there are plural target ink-droplet ejection modules 40 (i.e., the ink-droplet ejection modules 40 whose corresponding supply valves 52 are opened), the ink is simultaneously supplied to the plural target ink-droplet ejection modules 40.

Further, in step 164, ink droplets are ejected from all of the nozzles of the target ink-droplet ejection module 40. At this time, since all of the recovery valves 56 including the recovery valve 56 corresponding to the target ink-droplet ejection module 40 are closed, the ink (ink that is relatively highly deteriorated) remaining inside the target ink-droplet ejection module 40 is all ejected (discharged) as the ink droplets from the nozzles of the target ink-droplet ejection module 40. As a result, the ink inside the target ink-droplet ejection module 40 is replaced by relatively clean ink which is newly supplied to the target ink-droplet ejection module 40.

When the ink supply system is configured such that when the supply valve provided corresponding to each of the ink-droplet ejection modules is opened, the ink is supplied to the ink-droplet ejection module corresponding to the opened supply valve (i.e., the selection of the target ink-droplet ejection module and the supply of the ink to the target ink-droplet ejection module are simultaneously performed by opening the supply valve), in order to simultaneously supply the ink to the plural ink-droplet ejection modules to simultaneously perform the maintenance operations for the plural ink-droplet ejection modules, the plural supply valves respectively corresponding to the plural ink-droplet ejection modules need to be simultaneously opened. Due thereto, a relatively large current flows and, thus, increase in capacity of a power source is required.

Figure 4A:
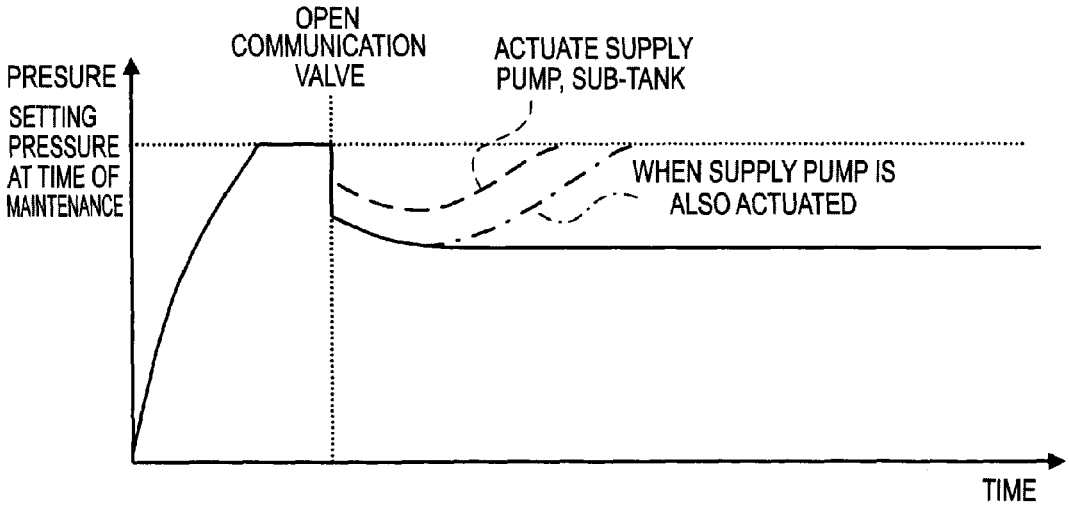
FIGS. 4A and 4B are charts showing examples of transitions of pressure inside a common flow path during the maintenance operation.
Figure 4B:
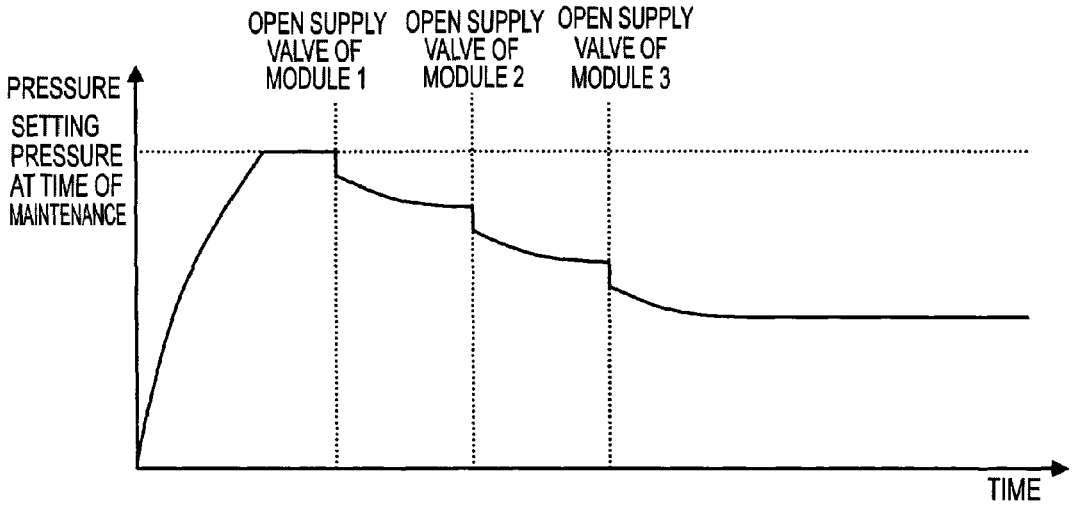

If, in order to avoid the foregoing, timings when the plural supply valves corresponding to the plural ink-droplet ejection modules are opened is offset to sequentially perform the maintenance operation of the respective ink-droplet ejection modules, the pressure inside the common flow path is decreased every time the new supply valve is opened as shown in FIG. 4B as an example. An ink pressure (initial pressure), at which the ink supply to the ink-droplet ejection module corresponding to the newly opened supply valve is started, is also decreased every time the supply valve is newly opened. Therefore, due to the variation in the ink pressure (initial pressure) when performing the maintenance operations in the respective ink-droplet ejection modules, the result of the maintenance operation varies such that, for example, an ink-droplet ejection module appears which is insufficient in removal of clogging of the nozzles or the discharge of the deteriorated ink in spite of completion of the maintenance operation. Moreover, if the supply valve is opened after the pressure inside the flow path sufficiently increased in order to eliminate this problem, a time required for the maintenance operations for the plural ink-droplet ejection modules will become longer, and the use of a higher-capacity pump will increase the size of the apparatus due to the increase in the size of the pump.

In contrast, in the exemplary embodiment, by opening the supply valve 52, the target ink-droplet ejection module 40 is selected, and the supply of the ink to the selected ink-droplet ejection module is performed by opening the communication valve 66. Accordingly, even when there are plural target ink-droplet ejection modules 40, the maintenance operation (ink supply) of the target plural ink-droplet ejection modules 40 may be simultaneously performed without simultaneously opening the plural supply valves 52 corresponding to the respective target ink-droplet ejection modules 40. By simultaneously performing the maintenance operations (ink supply) for the plural target ink-droplet ejection modules 40 by opening the communication valve 66, the same pressure is applied, as the initial pressure of the ink, to the respective target ink-droplet ejection modules 40, as shown in FIG. 4A as an example. Further, the pressure of the ink supplied to the respective ink-droplet ejection modules 40 undergoes a transition during the maintenance operation as indicated in a solid line in FIG. 4A, and a uniform maintenance operation is performed in the respective ink-droplet ejection modules 40.

In step 164, the controller 70 causes the maintenance unit to perform the maintenance operation for the target ink-droplet ejection module 40. Thereby, the ink droplets ejected from the nozzles of the target ink-droplet ejection module 40 is adhered to the receiving member of the maintenance unit and the ink droplets are prevented from scattering. Further, the nozzle surfaces of the target ink-droplet ejection module 40 are cleaned by the cleaning member of the maintenance unit, and the target ink-droplet ejection module 40 returns to a state which is capable to eject, in response to a supply of the drive signal to the ejection mechanism, the ink droplets precisely corresponding to the supplied drive signal.

When the maintenance operations for the target ink-droplet ejection modules 40 have been completed, as described above, in next step 166, the recovery pump 62 is reversely rotated in a predetermined short time by the pump driving circuit 74. In step 168, the communication valve 66 is closed by the valve driving circuit 78. Thereby, the pressure (positive pressure) applied to the common flow path is released. Further, the supply of the ink to the target ink-droplet ejection modules 40 is stopped. Then, in step 170, all of the supply valves 52 are opened by the valve driving circuits 76, and in next step 172, all of the recovery valves 56 are opened by the valve driving circuits 77, and the maintenance processing ends. The procedures of opening the supply valves 52 and the recovery valves 56 may to be performed in several times, respectively, as in steps 154 and 156 as described before.

Although, in the exemplary embodiment, the pressure for supplying the ink to the target ink-droplet ejection modules 40 is generated by the recovery pump 62, the invention is not limited to this, and the supply pump 48 may be normally rotated after the communication valve 66 is opened. Thereby, as indicated by an alternate long and short dash line, the ink pressure decreased due to the opening of the communication valve 66 recovers by the normal rotation of the supply pump 48, and an average value of the ink supply pressure applied to the target ink-droplet ejection modules 40 during the performance of the maintenance operation is increased.

Second Exemplary Embodiment

Next, a second exemplary embodiment is described. The same reference numerals are given to the same parts as those of the first exemplary embodiment, and only parts different from those of the first exemplary embodiment are described.

Figure 5:
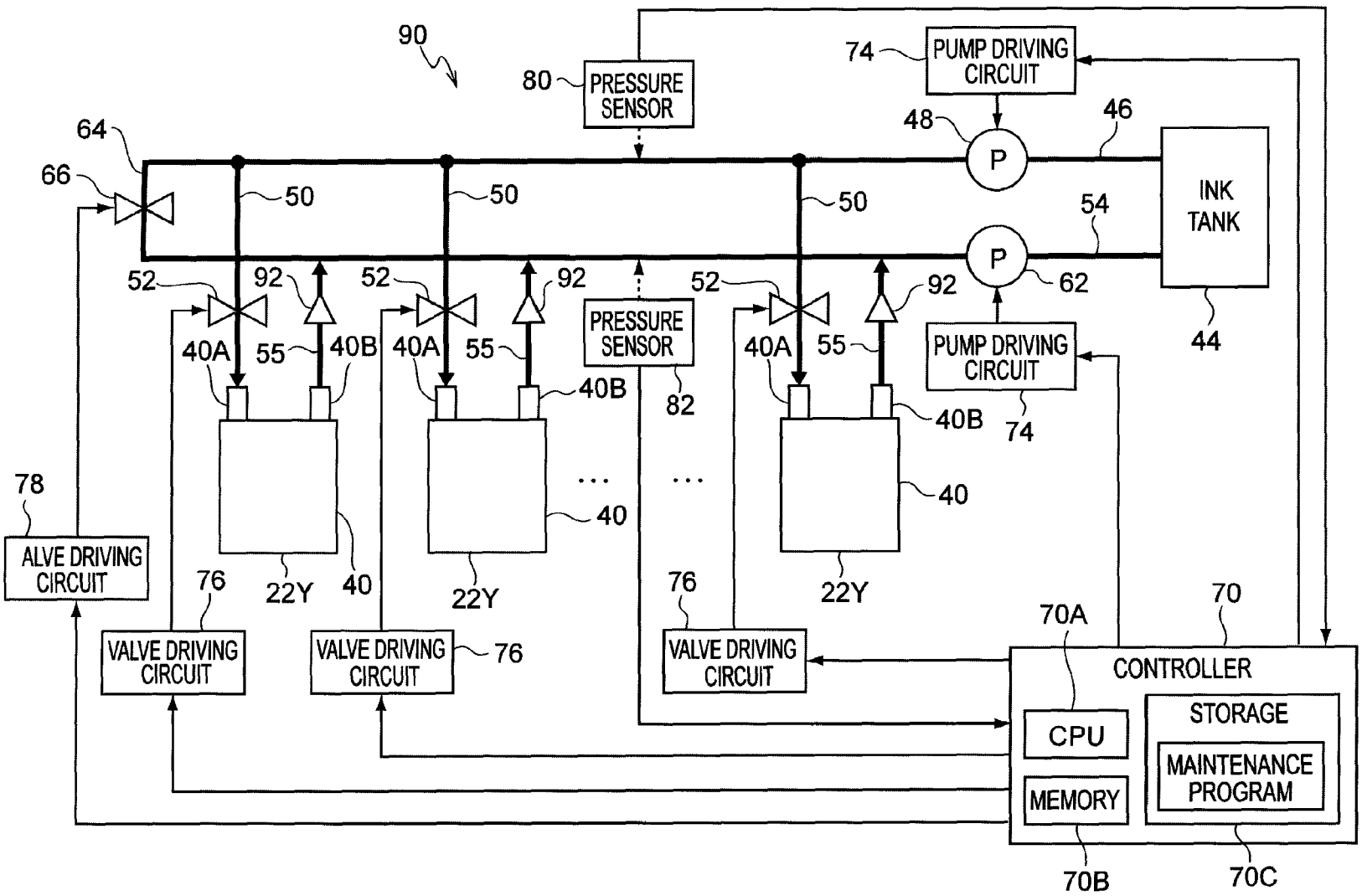
FIG. 5 is a schematic configuration diagram of an ink supply system according to a second exemplary embodiment.

FIG. 5 shows an ink supply system 90 according to the second exemplary embodiment. The ink supply system 90 is different from the ink supply system 42 described in the first exemplary embodiment in that one-way valves 92 are provided in place of the recovery valves 56, and that the valve driving circuits 77 are omitted.

Figure 6A:
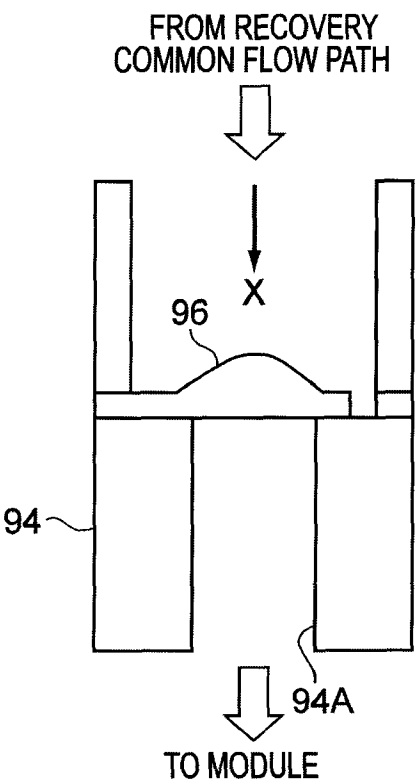
FIGS. 6A to 6C are schematic diagrams showing an example of a configuration of a one-way valve.
Figure 6B:
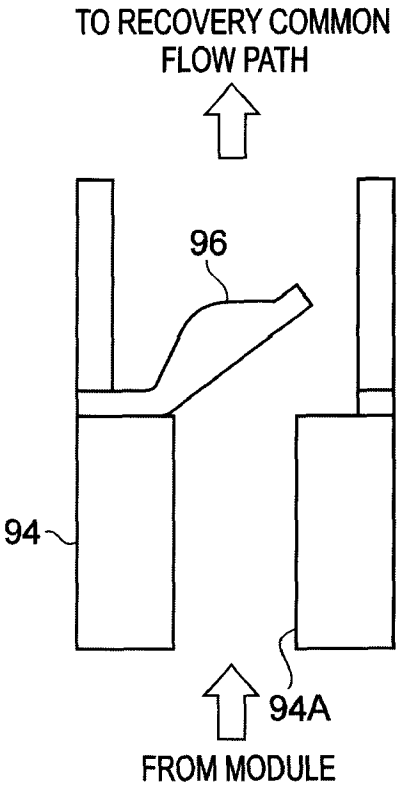
Figure 6C:
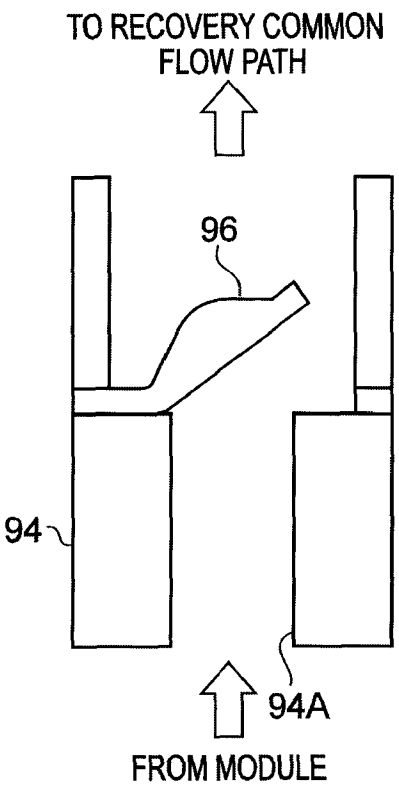

Each of the one-way valves 92 permits flow of the ink in a direction from the ink-droplet ejection module 40 toward the recovery common tube 54 and, on the other hand, blocks flow of the ink in a direction from the recovery common tube 54 toward the ink-droplet ejection module 40. For example, the one-way valve 92 includes a stop member 94 and a valve element 96 as shown in FIG. 6. The stop member 94 is formed in columnar shape, and is provided with a through-hole 94A along its axial line, through which the ink can flow. The valve element 96 is formed of a flexible material, has a substantially flat shape that can cover the entire opening of the through-hole 94A. One end portion (base portion) of the valve element 96 is fixed to one end surface of the stop member 94, and an intermediate portion thereof is folded so that the other end portion (tip portion) is located at an opening position separated by a predetermined distance from the end surface of the stop member 94 (refer to FIGS. 6B and 6C).

By this configuration, when the ink is not flowing inside the recovery tube 55, or when there is no pressure difference between the ink-droplet ejection module 40 side and the recovery common tube 54 side with respect to the one-way valve 92, the valve element 96 is located at the opening position at which the tip portion of the valve element 96 is separate from the end surface of the stop member 94, as shown in FIG. 6C. When the ink flows through the recovery tube 55 from the ink-droplet ejection module 40 toward the recovery common tube 54, the valve element 96 is still kept in the opening position as shown in FIG. 6B. On the other hand, when the ink flows through the recovery tube 55 from the recovery common tube 54 toward the ink-droplet ejection module 40, the valve element 96 is pressed toward the ink-droplet ejection module 40 side by the ink flowing into the one-way valve 92 from the recovery common tube 54 side, thereby the valve element 96 is displaced so that the tip portion of the valve element 96 moves to a closing position at which the tip portion contacts with the end surface of the stop member 94, as shown in FIG. 6A. Thus, the flow of the ink from the recovery common tube 54 toward the ink-droplet ejection module 40 in the recovery tube 55 is blocked.

The one-way valve 92 according to the exemplary embodiment corresponds to a third opening and closing mechanism.

The maintenance processing according to the second exemplary embodiment, whose illustration is omitted, is different from the maintenance processing of first exemplary embodiment (FIG. 3) in that the step of closing all of the recovery valves 56 (step 158) and the step of opening all of the recovery valves 56 (step 172) are omitted. In the second exemplary embodiment, when the recovery pump 62 is normally rotated (step 162 of FIG. 3), pressure (positive pressure) is applied to the recovery common tube 54 and the respective recovery tubes 55 and, thereby, the valve elements 96 are pressed by the ink and the one-way valves 92 provided at the respective recovery tubes 55 are put into a closed state (refer to FIG. 6A). When the recovery pump 62 is reversely rotated (step 166 of FIG. 3), the pressure inside the recovery common tube 54 and the recovery tubes 55 is decreased and, thereby, the one-way valves 92 provided at the respective recovery tubes 55 return to an opened state, respectively (refer to FIGS. 6B and 6C).

In this manner, by using the one-way valves 92 as the third opening and closing mechanism that open and close the recovery flow paths, the recovery tubes 55 can be closed and opened only by normally rotating or reversely rotating the existing recovery pump 62. Accordingly, the valve driving circuits 77 can be omitted, and the configuration of the apparatus will be simpler.

Figure 7B:
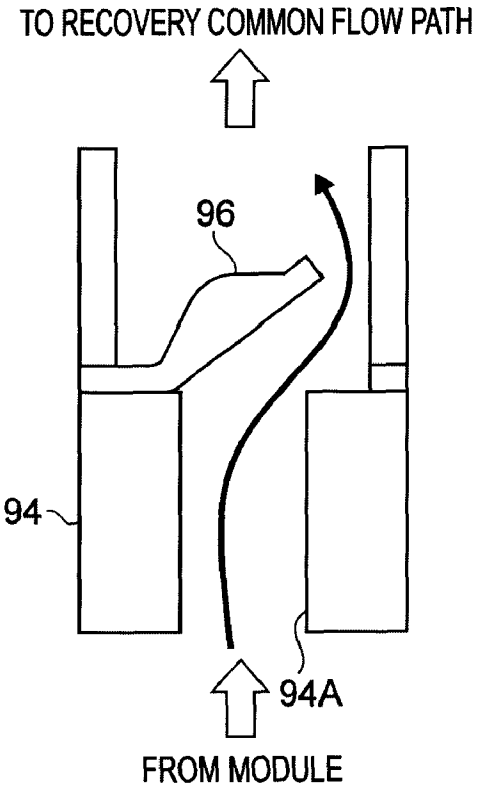
FIGS. 7A and 7B are schematic diagrams showing another example of the configuration of the one-way valve.
Figure 7A:
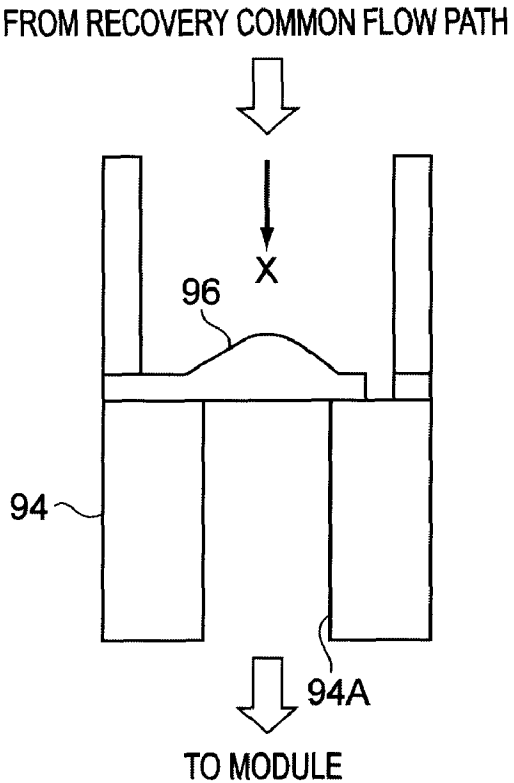

The one-way valve is not limited to the configuration shown in FIG. 6, and a configuration shown in FIG. 7, for example, may be employed. A one-way valve shown in FIG. 7 is different from the one-way valve shown in FIG. 6 in that the intermediate portion of the valve element 96 is not folded in static condition. In addition to when pressure (positive pressure) is applied to the recovery common tube 54 and the respective recovery tubes 55, when the ink is not flowing inside the recovery tubes 55, or when there is no pressure difference between the ink-droplet ejection module 40 side and the recovery common tube 54 side with respect to the one-way valve, the valve element 96 is kept in the closed state in which the tip portion of the valve elements 96 is in contact with the end surface of the stop member 94 as shown in FIG. 7A. On the other hand, when the ink flows through the recovery tube 55 from the ink-droplet ejection module 40 toward the recovery common tube 54, the valve element 96 is pressed toward the recovery common tube 54 by the ink flowing into the one-way valve from the ink-droplet ejection module 40, and the valve element 96 is displaced so that the tip portion thereof moves to the opening position from the end surface of the stop member 94 as shown in FIG. 7B. Thereby, the ink flows from the ink-droplet ejection module 40 toward the recovery common tube 54. When the configuration shown in FIG. 7 is applied for the one-way valve, the one-way valve (valve element 96) becomes a resistance to the flow of the ink from the ink-droplet ejection module 40 side to the recovery common tube 54 side and, therefore, the configuration shown in FIG. 6 may be preferable.

Further, the one-way valve may have a configuration shown in FIG. 8. A one-way valve shown in FIG. 8 has a spherical valve element 98 formed of a material having a larger specific gravity than that of the liquid such as the ink, and a housing part 100 that houses the valve element 98. The housing part 100 is formed in a columnar shape, is provided with a through-hole 100A along an axial line therefore, and is arranged so that the axial line extends in a vertical direction. A diameter of the through-hole 100A is smaller than that of the valve element 98. In the through-hole 100A, there is formed an inclined portion 100B having a diameter gradually increasing upward from an intermediate portion of the housing part 100 along the vertical direction and thus having a shape corresponding to a part of a cone. A housing portion 100C having a diameter larger than that of the valve element 98 is formed in an upper portion of the inclined portion 100B.

Figure 8B:
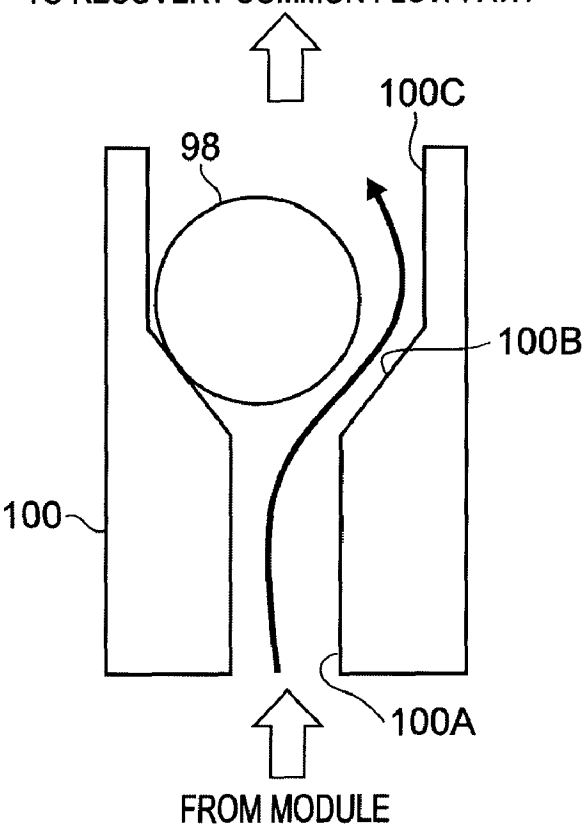
FIGS. 8A and 8B are schematic diagrams showing another example of the configuration of the one-way valve.
Figure 8A:
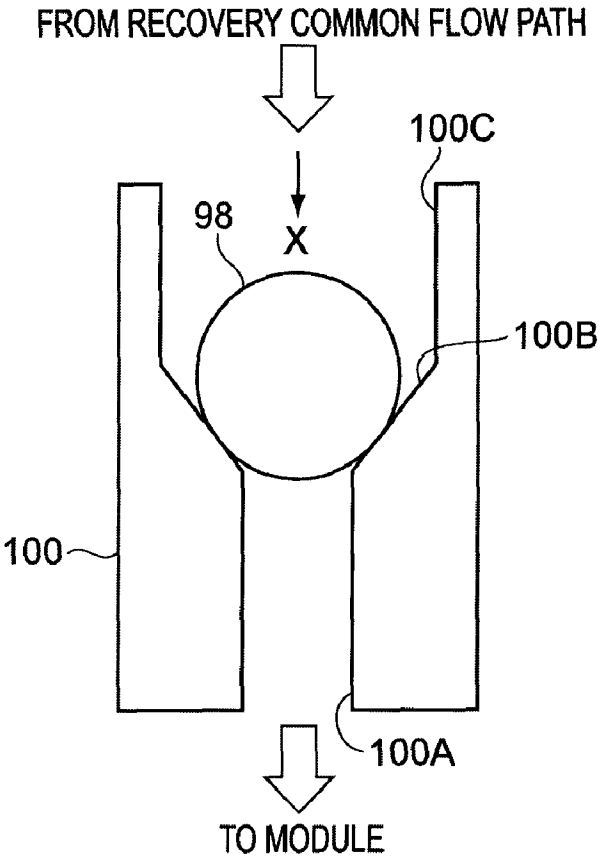

In the one-way valve shown in FIG. 8, when pressure (positive pressure) is applied to the recovery common tube 54 (the recovery common flow path) and the respective recovery tubes 55 (the recovery flow paths), when the ink is not flowing inside the recovery tube 55, or when there is no pressure difference between the ink-droplet ejection module 40 side and the recovery common tube 54 side with respect to the one-way valve, as shown in FIG. 8A, the valve element 98 comes into contact with the inclined portion 100B by gravity acting on the valve element 98, and is kept in a state in which it closes the flow path inside the one-way valve (through-hole 100A). On the other hand, when the ink flows through the recovery tube 55 from the ink-droplet ejection module 40 toward the recovery common tube 54, the valve element 98 is pressed toward the recovery common tube 54 by the ink flowing into the one-way valve from the ink-droplet ejection module 40 side, and the valve element 98 moves upward along the inclined surface of the inclined portion 100B as shown in FIG. 8B, which allows the ink to flow from the ink-droplet ejection module 40 toward the recovery common tube 54. When the configuration shown in FIG. 8 is applied for the one-way valve as well, the one-way valve (valve element 98) becomes a resistance to the flow of the ink from the ink-droplet ejection module 40 toward the recovery common tube 54, and thus, the configuration shown in FIG. 6 is preferable.

Third Exemplary Embodiment

Next, a third exemplary embodiment according to the invention will be described. The same reference numerals are given to the same parts as those of the first exemplary embodiment, and only parts different from those of the first exemplary embodiment are described.

Figure 9:
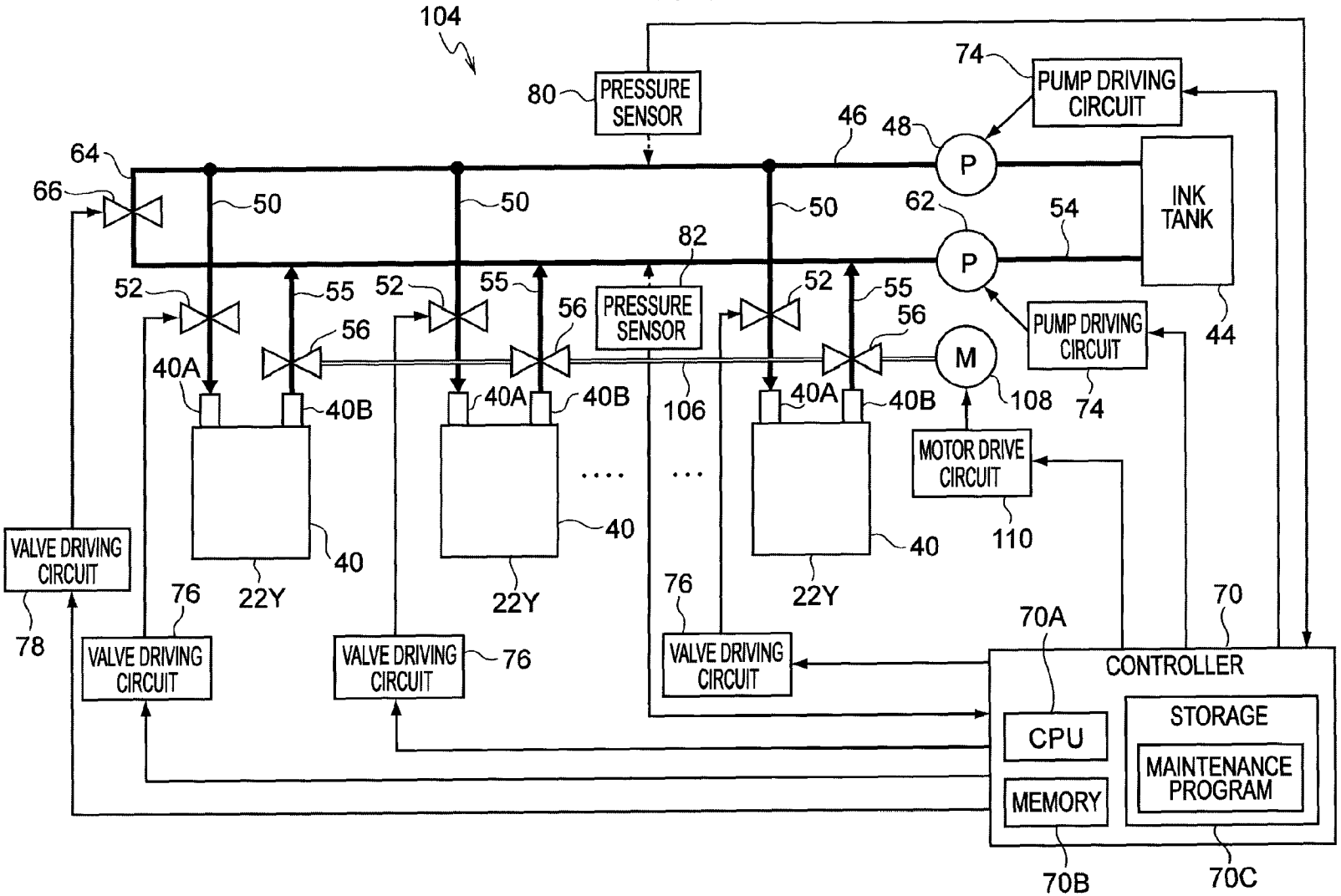
FIG. 9 is a schematic configuration diagram of an ink supply system according to a third exemplary embodiment.

FIG. 9 shows an ink supply system 104 according to the third exemplary embodiment. The ink supply system 104 is configured such that the recovery valves 56 provided in the respective recovery tube 55 are connected to a single interlocking shaft 106, and that due to the rotation of the interlocking shaft 106, the opening and closing of the recovery tubes 55 is interlocked (i.e., the opening and closing operations of the recovery tubes 55 are linked). An eccentric cam can be applied, for example, as each of the recovery valves 56 of the above-described configuration. In this case, the eccentric cams as the recovery valves 56 are attached to the interlocking shaft 106 so that the phases thereof are all in the same phase. The interlocking shaft 106 and the respective eccentric cams as the recovery valves 56 are arranged so that when the interlocking shaft 106 is rotated to a position where end portions of the eccentric cams along a long axis thereof oppose the recovery tubes 55, the end portions press and displace the recovery tubes 55 into a flat cross-sectional shape (i.e., put the recovery tubes 55 into the closed state).

The interlocking shaft 106 is connected to a rotating shaft of a motor 108 such as a stepping motor or the like, and rotates integrally with the rotating shaft of the motor 108. Moreover, the motor 108 is connected to the controller 70 through a motor driving circuit 110.

In the third exemplary embodiment, the recovery valve 56 corresponds to the third opening and closing mechanism, and the interlocking shaft 106 and the motor 108 correspond to an interlocking mechanism.

Maintenance processing according to the third exemplary embodiment (whose illustration is omitted) is different from the maintenance processing of the first exemplary embodiment (FIG. 3) in that the closing of all of the recovery valves 56 (step 158) and the opening of all of the recovery valves 56 (step 172) are performed by rotating the interlocking shaft 106 by the motor 108. As described in the first exemplary embodiment, when the recovery valves 56 are solenoid valves, the procedure of the closing or opening of all of the recovery side valves 56 is preferably be performed in several times. However, when the recovery valves 56 are interlocked by the interlocking mechanism (the interlocking shaft 106 and the motor 108) as described above, the control of closing and opening all of the recovery valves 56 will be easier.

Fourth Exemplary Embodiment

Next, a fourth exemplary embodiment of the invention will be described. The same reference numerals are given to the same parts as those of the first exemplary embodiment, and only parts different from those of the first exemplary embodiment are described.

Figure 10:
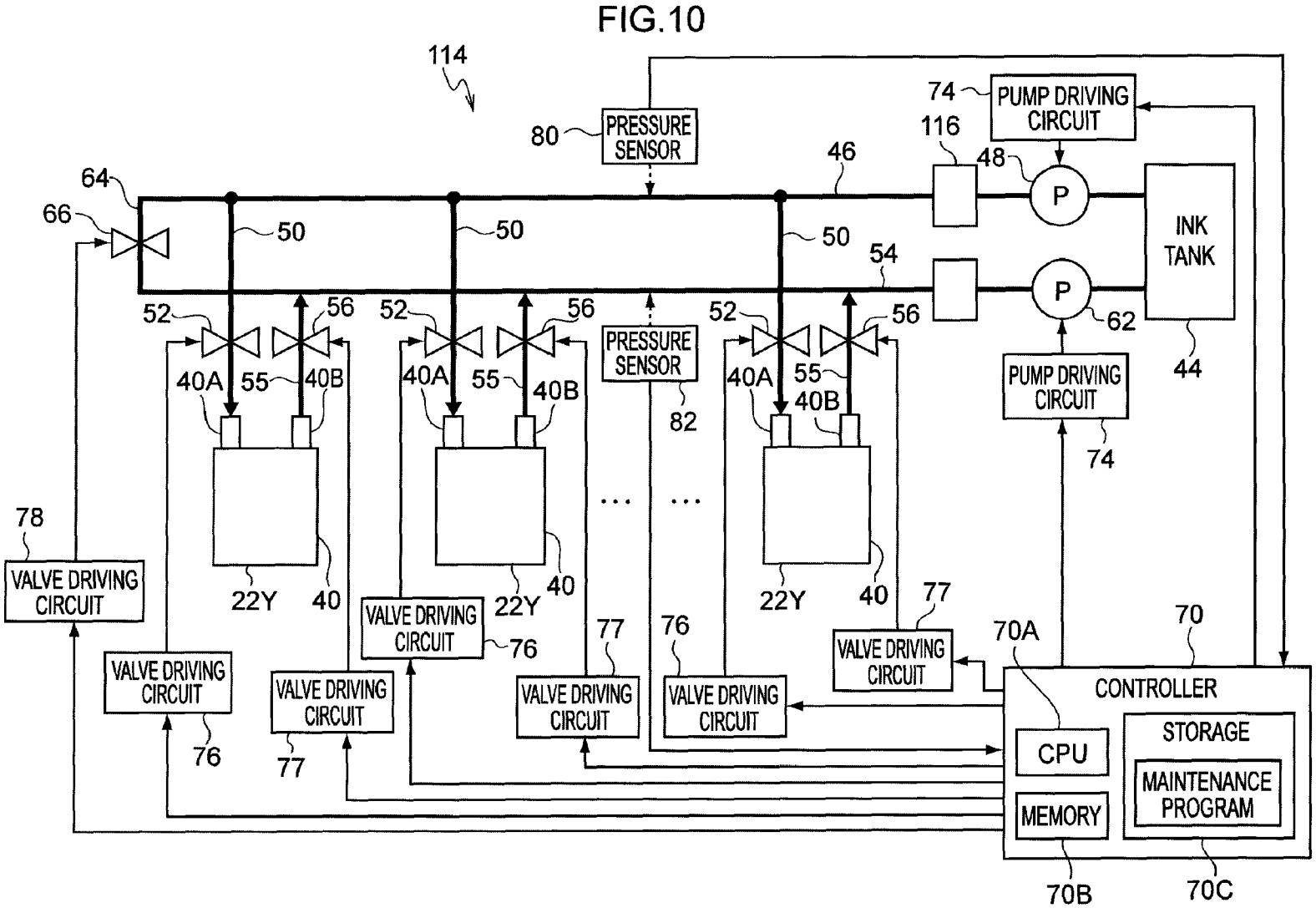
FIG. 10 is a schematic configuration diagram of an ink supply system according to a fourth exemplary embodiment.

FIG. 10 shows an ink supply system 114 according to the fourth exemplary embodiment. The ink supply system 114 is different from the ink supply system 42 of the first exemplary embodiment in that sub-tanks 116 are provided at a position in the ink-droplet ejection module 40 side from the supply pump 48 of the supply side common tube 46, and at a position in the ink-droplet ejection module 40 side from the recovery pump 62 of the recovery common tube 54.

Figure 11A:
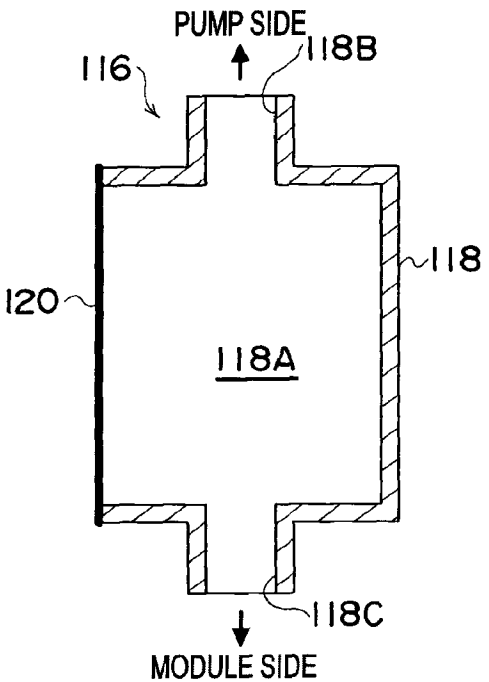
FIGS. 11A to 11C are schematic diagrams showing a configuration and an operation of a sub-tank.

As shown in FIG. 11, each of the sub-tanks 116 includes a case 118 in which a reservoir 118A for reserving the ink is provided, and a pair of communication ports 116B, 116C communicating with the reservoir 118A is provided. In the reservoir 118A of the case 118, an opening is provided in a direction orthogonal to the flow direction of the ink flowing through the communication ports 116B, 116C. A film 120 formed of a flexible material such as rubber is attached to the case 118 so as to close the opening. The sub-tank 116 corresponds to a pressure-fluctuation suppressing unit.

Figure 11B:
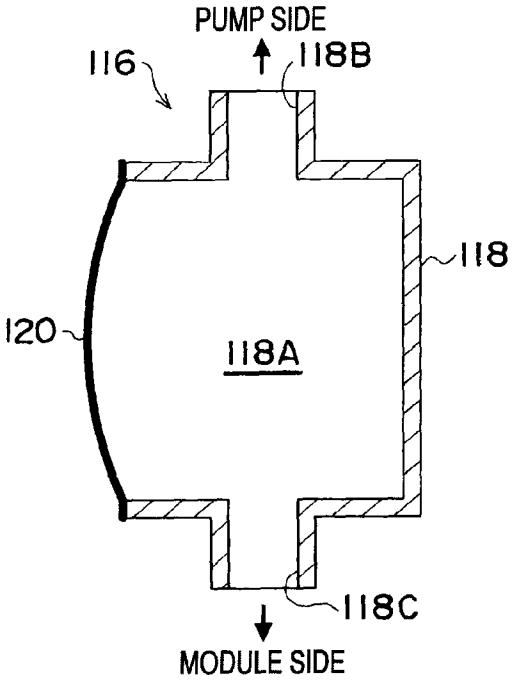
Figure 11C:
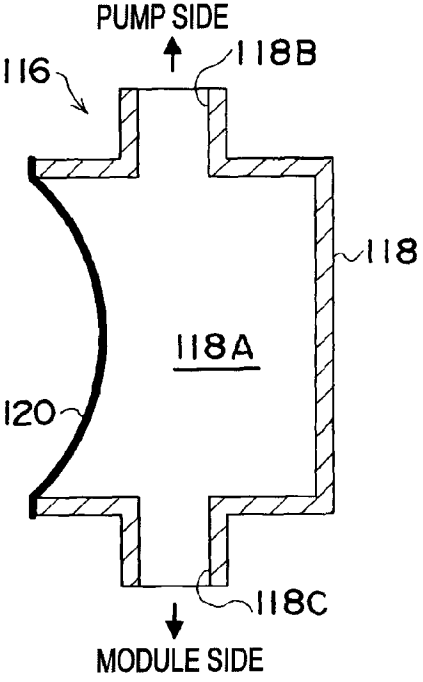

When a pressure inside the common flow path in which the sub-tank 116 is provided increases, the film body 120 deflects toward outside of the case 118 due to a pressure of the ink reserved inside the reservoir 118A of the sub-tank 116 as shown in FIG. 11B. Due to this increase in the volume of the reservoir 118A, the volume of the common flow path including the reservoir 118A also increases and, thereby, an increase amount of the pressure inside the common flow path including the reservoir 118A is reduced. When the pressure inside the common flow path is decreased, the film body 120 deflects toward inside of the case 118 due to the decrease in the pressure of the ink reserved inside the reservoir 118 of the sub-tank 116 as shown in FIG. 11C. Due to this decrease in the volume of the reservoir 118A, the volume of the common flow path including the reservoir 118A also decreases and, thereby, a decrease amount of the pressure inside the common flow path including the reservoir 118A is reduced. In this way, minute fluctuations in the pressure inside the common flow path (i.e., pulsation attributed to the pump) can be suppressed.

In the fourth exemplary embodiment, basically, the same maintenance processing as that of the first exemplary embodiment is performed. However, the sub-tank 116 is provided in a section of the common flow path, in which the pressure is raised (i.e., section between the communication valve 66 and the recovery pump 62) by continuing the normal rotation of the recovery pump 62 (steps 160, 162 of FIG. 3) before the communication valve 66 is opened, and an amount of the ink reserving the pressure is increased in this section. Therefore, as indicated by a dashed line in FIG. 4A, a decrease amount of the initial pressure of the ink in a moment when the communication valve 66 is opened is reduced. While the dashed line shown in FIG. 4A indicates transition of the ink supply pressure when the sub-tank 116 is provided and the supply pump 48 is also normally rotated, the provision of the sub-tank 116 reduces the decrease amount of the initial pressure of the ink even if the supply pump 48 is not actuated.

In the above exemplary embodiments, the configuration is described in which the supply valves 52 is used as the first opening and closing mechanism, the recovery pump 62 is used as the first pressurizing unit, and after reserving pressure inside the recovery common tube 54, the communication valve 66 is opened to supply the ink to the target ink-droplet ejection module 40. However, the embodiments are not limited to this. In a configuration as in the first exemplary embodiment, in which the respective recovery valves 56 can be opened and closed independently from one another, it may be configured such that the ink can be supplied to each of the ink-droplet ejection modules 40 also from the discharging port 40B and can be discharged also from the supply port 40A. In this case, the recovery valve 56 can be used as the first opening and closing mechanism, the supply pump 48 can be used as the first pressure unit, the recovery side-valve 56 corresponding to the target ink-droplet ejection module 40 may be opened to reserve the pressure inside the supply common tube 46, and then, the communication valve 66 may be opened to supply the ink to the target ink-droplet ejection module 40 through the recovery valve 56.

In the above configuration, the supply common tube 46 corresponds to the first common flow, the recovery common tube 54 corresponds to the second common flow path, the recovery tube 55 corresponds to the first flow path, the supply tube 50 corresponds to the second flow path, the supply valve 52 corresponds to the third opening and closing mechanism, the recovery pump 62 corresponds to the second pressurizing unit, the pressure sensor 80 corresponds to the pressure detector, the discharging port 40B corresponds to the second distribution port, and the supply port 40A corresponds to the first distribution port.

While, in the above exemplary embodiments, a configuration is described in which the communication valve 66 provided at the communication tube 64 is used as the second opening and closing mechanism, the embodiments are not limited to this. For example, when the communication tube 64 is omitted as in an ink supply system 124 shown in FIG. 12, an opening and closing valve 126 may be provided, for example, in a position at the ink-droplet ejection module 40 side from the supply pump 48 of the supply common tube 46, and the opening and closing valve 126 may be connected to the controller 70 through a valve driving circuit 128 and used as the second opening and closing mechanism. In this configuration, in a state in which the opening and closing valve 126 is closed, the supply valve 52 corresponding to the target ink-droplet ejection module 40 may be opened to reserve pressure in a section between the supply pump 48 and the opening and closing valve 126 of the supply common tube 46, and then the opening and closing valve 126 may be opened. Thus the ink is supplied to the target ink-droplet ejection module 40.

Figure 12:
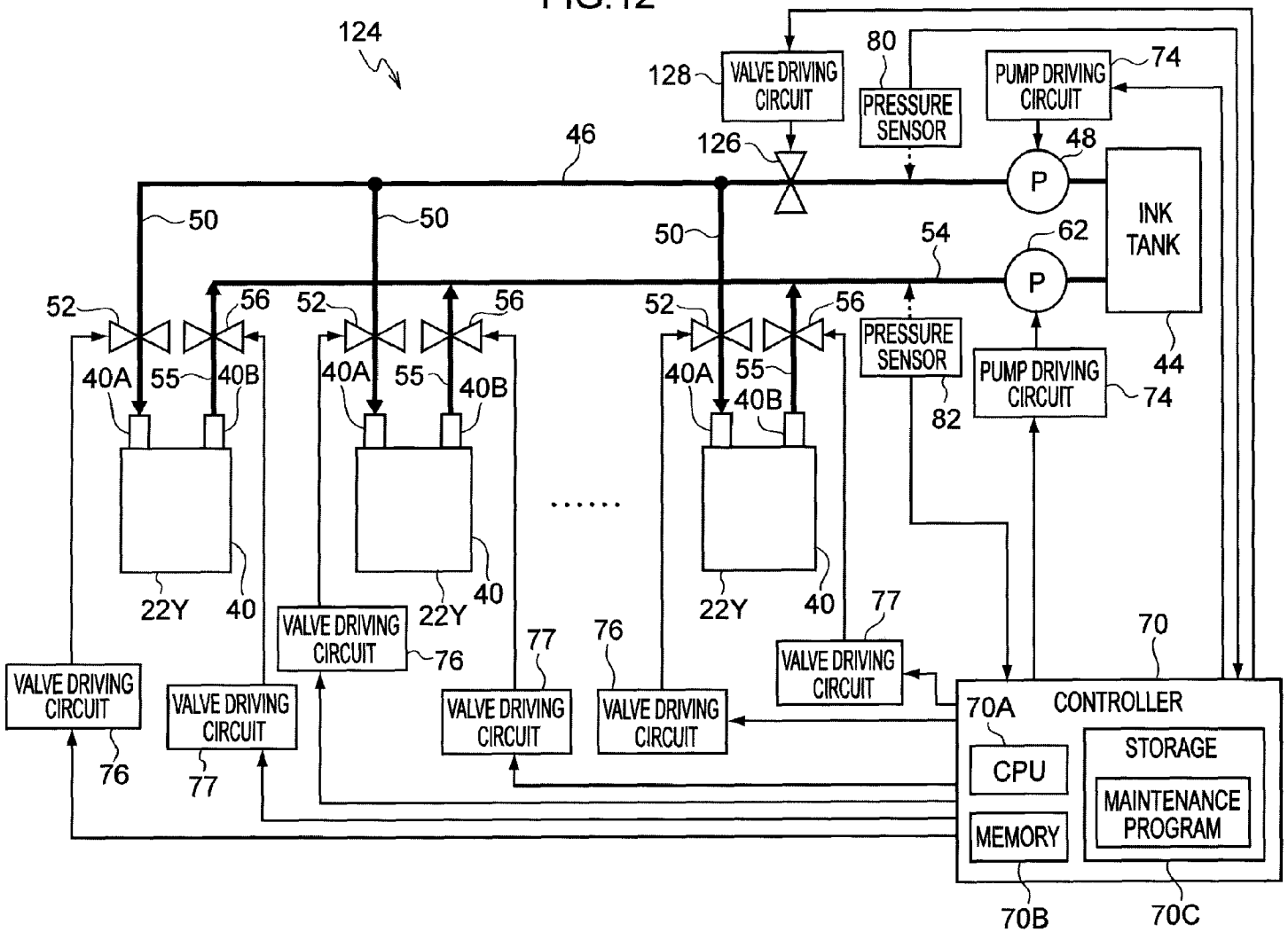
FIG. 12 is a schematic configuration diagram showing another configuration of the ink supply system.

In the configuration shown in FIG. 12, the supply common tube 46 corresponds to the common flow path, the recovery common tube 54 corresponds to the first common flow path, the supply port 40A corresponds to the first distribution port, the discharging port 40B corresponds to the second distribution port, the supply tube 50 corresponds to the first flow path, the recovery tube 55 corresponds to the second flow path, the supply valve 52 corresponds to the first opening and closing mechanism, the recovery valve 56 corresponds to the third opening and closing mechanism, the supply pump 48 corresponds to the first pressurizing unit, and the pressure sensor 80 corresponds to the pressure detector.

In the above exemplary embodiments, the ink-droplet ejection module 40 is described to be provided with the supply port 40A and the discharging port 40B as an example of the droplet ejection unit. However, the embodiments are not limited to this. One embodiment may employ a droplet ejection unit in which only the first distribution port is provided. For example, in an ink supply system 132 shown in FIG. 13, only the supply port 40A is provided in each of the ink-droplet ejection modules 40, and the recovery common tube 54, the recovery tubes 55, the recovery valves 56, the valve driving circuits 77, the recovery pump 62, the pump driving circuit 74 connected to the recovery pump 62, and the pressure sensor 82 are omitted as compared with the ink supply system 124 shown in FIG. 12. Also in this configuration, the ink is supplied to the target ink-droplet ejection module 40 by, in a state in which the opening and closing valve 126 is closed, opening the supply valve 52 corresponding to the target ink-droplet ejection module 40 to reserve pressure in the section between the supply pump 48 and the opening and closing valve 126 in the supply common tube 46, and then, opening the opening and closing valve 126.

Figure 13:
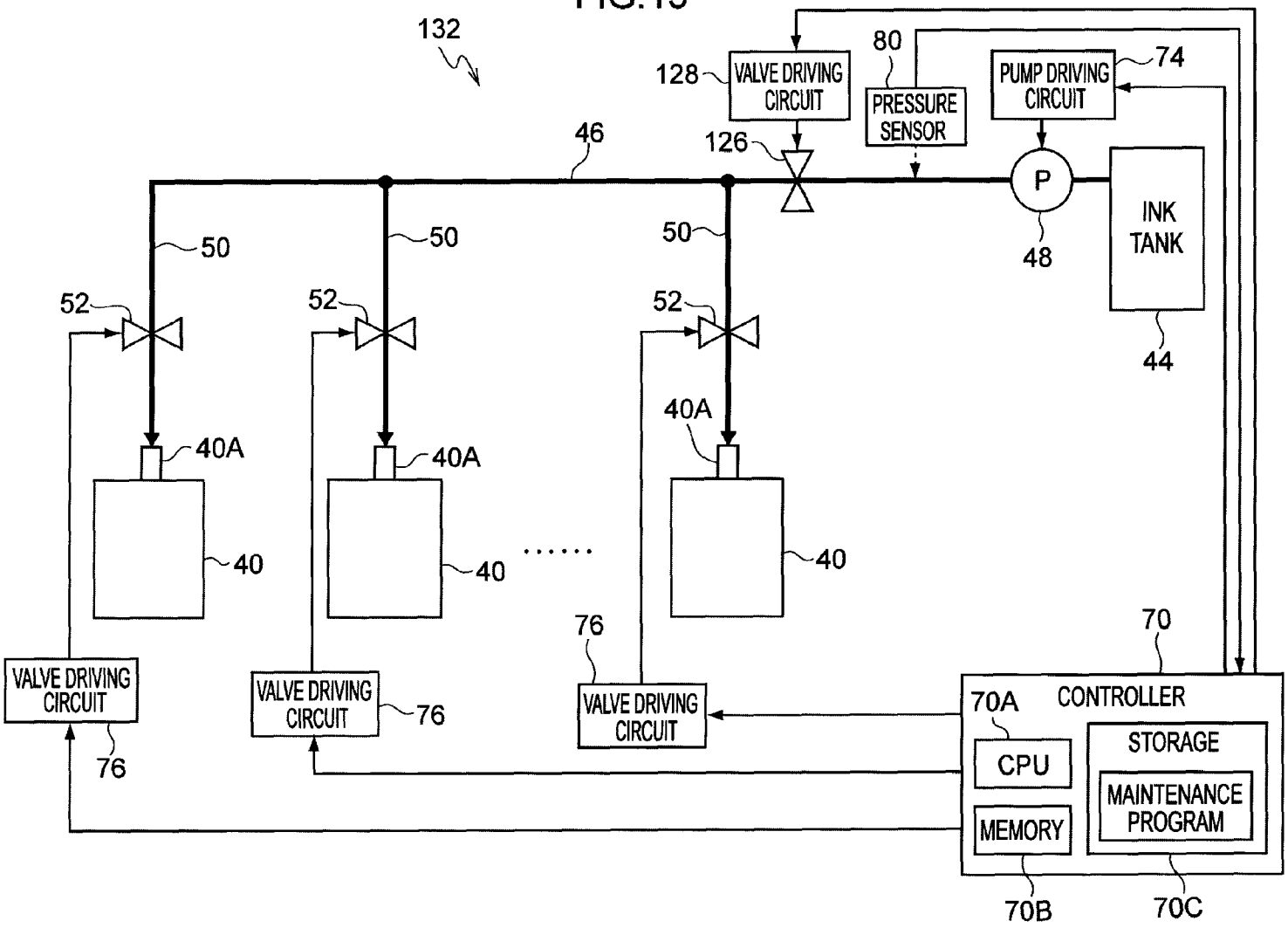
FIG. 13 is a schematic configuration system showing yet another configuration of the ink supply system.

In the configuration shown in FIG. 13, the supply common tube 46 corresponds to the common flow path, the supply port 40A corresponds to the first distribution port, the supply tube 50 corresponds to the first flow path, the supply valve 52 corresponds to the first opening and closing mechanism, the supply pump 48 corresponds to the first pressurizing unit, and the pressure sensor 80 corresponds to the pressure detector, respectively.

In the foregoing description, the ink jet recording apparatus is described as one example of the droplet ejection apparatus. However, the droplet ejection apparatus according is not limited to this. The droplet ejection apparatus may be, for example, a color filter manufacturing apparatus that ejects ink or the like on a film or glass to manufacture a color filter, an apparatus that ejects an organic EL solution on a substrate to form an EL display panel, an apparatus that ejects solder in a fused state on a substrate to form a bump for component mounting, an apparatus that ejects liquid including metal to form a wiring pattern, various types of film formation apparatuses that eject droplets to form a film, or any other apparatus that ejects droplets.

What is claimed is:

1. A droplet ejection apparatus comprising:

a common liquid flow path that distributes a liquid;

a plurality of droplet ejection units each respectively including at least a first distribution port that supplies the liquid and an ejection mechanism that ejects the supplied liquid as droplets;

a plurality of first flow paths that respectively connect each first distribution port to the common liquid flow path;

a plurality of first opening and closing mechanisms provided respectively at the plurality of first flow paths;

a first pressurizing unit that applies a positive pressure at least to the common liquid flow path;

a second opening and closing mechanism provided at the common liquid flow path at the first pressurizing unit side of connection portions that connect the common liquid flow path and the respective first flow paths; and a controller that, when the second opening and closing mechanism is closed, opens only one or more first opening and closing mechanisms corresponding to one or more target droplet ejection units which are maintenance targets, applies positive pressure by the first pressurizing unit to a section of the common liquid flow path at the first pressurizing unit side of the second opening and closing mechanism, and then opens the second opening and closing mechanism.

2. The droplet ejection apparatus according to claim 1, wherein, when a plurality of target droplet ejection units are present, the controller opens the corresponding plurality of first opening and closing mechanisms at respectively different times.

3. The droplet ejection apparatus according to claim 1, further comprising a pressure detector that detects a pressure in the section of the common liquid flow path, wherein the controller opens the second opening and closing mechanism after the pressure in the section detected by the pressure detector increases due to the actuation of the first pressurizing unit and reaches a predetermined value.

4. The droplet ejection apparatus according to claim 1, wherein:

the common liquid flow path comprises a first common flow path that recovers the liquid from the plurality of droplet ejection units, each of the plurality of droplet ejection units further includes a second distribution port capable of discharging the liquid, the droplet ejection apparatus further comprising:

a plurality of second flow paths that connect the second distribution ports to the first common flow path, respectively, and a plurality of third opening and closing mechanisms provided at the plurality of second flow paths, respectively; and the controller opens the second opening and closing mechanism when at least the third opening and closing mechanism corresponding to the target droplet ejection unit is closed.

5. The droplet ejection apparatus according to claim 4, wherein:

each of the plurality of third opening and closing mechanisms comprises a one-way valve that blocks a flow of the liquid from the first common flow path toward the second distribution port; and the controller applies the positive pressure to the first common flow path to close all of the plurality of the one-way valves.

6. The droplet ejection apparatus according to claim 4, further comprising a linking mechanism that links the opening and closing operations of the plurality of third opening and closing mechanisms, wherein the controller closes all of the plurality of third opening and closing mechanisms by the linking mechanism.

7. The droplet ejection apparatus according to claim 4, wherein:

the common liquid flow path further comprises a second common flow path that supplies the liquid to the plurality of droplet ejection units, and a communication flow path that communicates the first common flow path and the second common flow path;

the plurality of first flow paths connect the first distribution ports to the second common flow path, respectively;

the second opening and closing mechanism is provided at the communication flow path;

the first pressurizing unit is connected to the first common flow path so as to be capable of applying a positive pressure at least to the first common flow path;

the droplet ejection apparatus further comprises a second pressurizing unit connected to the second common flow path so as to be capable of applying a positive pressure at least to the second common flow path; and the controller applies the positive pressure to the second common flow path by the second pressurizing unit when the second opening and closing mechanism is opened.

8. The droplet ejection apparatus according to claim 1, further comprising one or more pressure-fluctuation suppressing units that are provided at the common liquid flow path, each comprising a reservoir that stores the liquid, and configured so as to vary a volume of the reservoir in accordance with a variation in pressure applied by the liquid.

9. The droplet ejection apparatus according to claim 1, wherein:

the common liquid flow path comprises a first common flow path that recovers the liquid from the plurality of droplet ejection units, a second common flow path that supplies the liquid to the plurality of droplet ejection units, and a communication flow path that communicates the first common flow path and the second common flow path;

the plurality of first flow paths connect the first distribution ports to the second common flow path, respectively;

the second opening and closing mechanism is provided at the communication flow path;

the first pressurizing unit is connected to the first common flow path so as to be capable of applying a positive pressure at least to the first common flow path;

the droplet ejection apparatus further comprises a second pressurizing unit connected to the second common flow path so as to be capable of applying a positive pressure at least to the second common flow path; and when a maintenance operation of the droplet ejection units is not performed, the controller opens the plurality of the first opening and closing mechanisms and applies positive pressure to the second common flow path by the second pressurizing unit to circulate the liquid along a flow path from the second common flow path, through respective first flow paths, the respective droplet ejection units, and the respective second flow paths, to the first common flow path.

* * * * *